United States Patent [19]

Tamagawa et al.

[11] Patent Number: 4,940,656

[45] **Date of Patent: * Jul. 10, 1990**

[54] PHOTOGRAPHIC SUPPORT

[75] Inventors: Shigehisa Tamagawa; Tetsuro Fuchizawa, both of Shizuoka, Japan

[73] Assignee: Fuji Photo Film Co., Ltd., Kanagawa, Japan

[ * ] Notice: The portion of the term of this patent subsequent to Aug. 22, 2006 has been disclaimed.

[21] Appl. No.: 367,806

[22] Filed: Jun. 19, 1989

Related U.S. Application Data

[63] Continuation of Ser. No. 171,138, Mar. 16, 1988, Pat. No. 4,859,577, which is a continuation of Ser. No. 41,666, Apr. 20, 1987, abandoned, which is a continuation of Ser. No. 894,476, Aug. 5, 1986, abandoned, which is a continuation of Ser. No. 727,892, Apr. 26, 1985, abandoned, which is a continuation of Ser. No. 469,970, Feb. 25, 1983, abandoned.

[30] Foreign Application Priority Data

Feb. 26, 1982 [JP] Japan ..... 57-30355

[51] Int. Cl.[5] ..... G03C 1/96

[52] U.S. Cl. ..... 430/538; 430/556; 430/557; 162/135; 162/158

[58] Field of Search ..... 430/536, 537, 538; 162/135, 158

[56] References Cited

U.S. PATENT DOCUMENTS 4,312,937 1/1982 Kasper et al. ..... 430/538
4,331,508 5/1982 Miyama et al. ..... 430/538
4,353,981 10/1982 Noda et al. ..... 430/538
4,384,040 5/1983 Meek ..... 430/538

OTHER PUBLICATIONS

The Condensed Chemical Dictionary (1950), pp. 471–473, Reinhold Publishing.

Swanson, Internal Sizing of Paper and Paperboard (1971), pp. 156–161.

*Primary Examiner*—Jack P. Brammer

*Attorney, Agent, or Firm*—McAulay Fisher Nissen & Goldberg

[57] ABSTRACT

A photographic support comprising a paper sheet coated with a polyolefin on both surfaces thereof, in which the paper sheet contains an alkylketene dimer mixtures, its alkyl chain composition being defined by the following equation:

$$\frac{\frac{1}{3}[C_{16}] + [C_{18}] + 10[C_{20} \text{ and more}]}{[C_{14} \text{ and less}]} \geqq 1$$

in which [$C_{14}$ and less] means the content of alkyl chains having carbon atoms of 14 and less; [$C_{16}$] means the content of an alkyl chain having 16 carbon atoms; [$C_{18}$] means the content of an alkyl chain having 18 carbon atoms; and [$C_{20}$ and more] means the content of alkyl chains having carbon atoms of 20 and more, the alkyl chain contents being represented by % in number of the total alkyl chain content of the alkylketene dimer composition. The photographic support is effectively resistant to permeation of a developing solution.

1 Claim, No Drawings

PHOTOGRAPHIC SUPPORT

This is a continuation of application Ser. No. 171,138, filed Mar. 16, 1988, now U.S. Pat. No. 4,859,577 which in turn, is a continuation of application Ser. No. 041,666, filed Apr. 20, 1987, now abandoned, which, in turn, is a continuation of application Ser. No. 894,476, filed Aug. 5, 1986, now abandoned, which, in turn, is a continuation of application Ser. No. 727,892, filed Apr. 26, 1985, now abandoned, which, in turn, is a continuation of application Ser. No. 469,970, filed Feb. 25, 1983, now abandoned.

This invention relates to a photographic support, and particularly relates to a water-proof photographic support. More particularly, this invention relates to a water-proof photographic support substantially free from being soiled by a developing solution at the edge portion produced by the cutting procedure.

There has been previously employed, as the photographic support, a baryta paper consisting of a paper coated with a baryta layer comprising mainly barium sulfate on one surface. Recently, however, a waterproof photographic support comprising a paper sheet coated with a hydrophobic polyolefin on both surfaces thereof has been developed and employed to cope with the requirement of a rapid development process with an automation system. At the present time, most of the baryta papers have been replaced with the water-proof photographic support.

Nevertheless, even though the water-proof polyolefin layers are provided to the both surfaces, the waterproof photographic support is apt to be soiled by a developing solution at the edge portion produced by the cutting procedure, because the hydrophilic wood pulp fibers constituting the paper sheet are liable to draw the developing solution into the paper sheet from the exposed edge portion. The so-produced edge soiling can be satisfactorily reduced by washing sufficiently the developed photographic paper with water for a long time. However, the washing procedure for a long time is naturally adverse to the requirement for reduction of the development time. For this reason, a measure for preventing permeation of a developing solution from the edge portion has been earnestly studied.

Until now, there is known and generally employed a measure for preventing permeation of a developing solution which involves incorporation of a sizing agent into the paper sheet. However, there necessarily arise various limitations to the sizing agent employable for the purpose, in view of the employment in the specific art of photographic paper. For instance, the sizing agent to be employed should be effective against permeation of either an alkaline solution or an alcohol such as most generally employed benzyl alcohol, both of which are contained in a developing solution. Moreover, the sizing agent should not decrease whiteness of the photographic paper and should not give any adverse effect to an image produced on the photographic paper such as production of fog. Accordingly, sizing agents generally employable for sizing a paper such as a rosin size and a petroleum resin size are not employable for sizing a paper sheet of the photographic support.

In view of the above-described requirements, there have been proposed a number of specific sizing agents for the use in the photographic support, such as a fatty acid soap sizing agent disclosed in Japanese Patent Publication No. 47(1972)-26,961, a wax sizing agent disclosed in U.S. Pat. No. 3,241,968, and an alkylketene dimer disclosed in Japanese Patent Provisional Publication No. 51(1976)-132,822. These sizing agents, however, are not considered to be satisfactory, because these sizing agents have certain drawbacks. More in detail, the fatty acid soap sizing agent is effective for prevention of permeation of the alcohol, while it is less effective against permeation of the alkaline solution. Moreover, the fatty acid soap is liable to be influenced by the quality of water employed in paper making. For instance, the fatty acid soap precipitates in a hard water to impart poor sizing effect to the paper sheet and/or to bring about disadvantageous features in the paper making process. The wax sizing agent is relatively effective for prevention of permeation of the alcohol, but is poor in the prevention of permeation of the alkaline solution, as is the same as the fatty acid soap. On the other hand, the alkylketene dimer is effective for preventing permeation of an alkaline solution contained in a developing solution, while it is extremely poor in preventing permeation of the alcohol. Moreover, the satisfactory prevention of permeation of the alkaline solution by the alkylketene dimer is accomplished only in the case where a relatively large amount of a preserving agent, that is, a polyamide-polyamine-epichlorohydrin resin is employed together with the alkylketene dimer. Thus, there has not been known a satisfactory sizing agent for the employment in a photographic support.

In view of the above-mentioned drawbacks of the prior arts, a number of improvements have been proposed until now. However, most of the improvements involve rather complicated stages for incorporating the sizing agents and require relatively high cost, because these improvements comprise use of a combination of plural sizing agents.

The primary object of the invention, accordingly, is to provide a photographic support capable of effectively keeping either an alkaline solution or an alcohol from permeation into the paper sheet, whereby enabling production of a photographic paper substantially free from the edge soiling, that is, substantially free from being soiled by a developing solution at the edge portion.

The secondary object of the invention is to provide a photographic support showing high whiteness in that the high whiteness is kept even in a long term storage.

The third object of the invention is to provide a photographic support that can be employed for the preparation of a photographic paper substantially free from edge soiling and further free from disadvantageous photographic features such as formation of fog.

The forth object of the invention is to provide a less expensive photographic support that is free from the drawbacks of the prior arts.

These objects are accomplished by the present invention residing in a photographic support comprising a paper sheet coated with a polyolefin on both surfaces thereof, in which the paper sheet contains an alkylketene dimer mixture, its alkyl chain composition being defined by the following equation [I]:

$$\frac{\frac{1}{3}[C_{16}] + [C_{18}] + 10[C_{20}\text{ and more}]}{[C_{14}\text{ and less}]} \geqq 1 \qquad [I]$$

in which $[C_{14}$ and less$]$ means the content of alkyl chains having carbon atoms of 14 and less; $[C_{16}]$ means the content of an alkyl chain having 16 carbon atoms; $[C_{18}]$ means the content of an alkyl chain having 18 carbon atoms; and [$C_{20}$ and more] means the content of alkyl chains having carbon atoms of 20 and more, the alkyl chain contents being represented by % in number of the total alkyl chain content of the alkylketene dimer composition.

The present invention is described more in detail, hereinafter.

The invention is characterized in that an alkylketene dimer mixture having a specifically defined alkyl chain composition is employed as a sizing agent.

As described hereinbefore, it is known that an alkylketene dimer is employable as a sizing agent in the art of paper preparation. According to the study of the present inventors, the commercially available alkylketene dimer is a mixture of alkylketene dimers having alkyl chains of 14 and less carbon atoms ($C_{14}$ alkylketene dimer is predominant) and an alkylketene dimer having alkyl chain of 16 carbon atoms in the ratio (in number) of approximately 1:1. More precisely, the commercially available alkylketene dimer is a mixture of alkylketene dimers having alkyl chains in which both of the alkyl chains of one alkylketene dimer have carbon atoms of 14 or less, alkylketene dimers having alkyl chains in which one alkyl chain has 14 or less carbon atoms and another alkyl chain has 16 carbon atoms, and an alkylketene dimer in which both of the alkyl chains have 16 carbon atoms, in the ratio (in number) of approximately 1:2:1, respectively. From this ratio, the aforementioned ratio of approximately 1:1 is obtained in total between the number of alkyl chains of 14 and less carbon atoms and the number of alkyl chains of 16 carbon atoms.

The present inventors studied a variety of alkylketene dimers having different alkyl chain compositions on their sizing effects against a developing solution, and have discovered that an alkylketene dimer mixture having an alkyl chain composition defined by the aforementioned equation [I] has prominent sizing effect against a developing solution in which such a prominent sizing effect against a developing solution is not anticipatable based on its general sizing characteristics such as Stöckigt sizing degree, alkaline sizing degree, and water absorptiveness (Cobb test).

The aforementioned equation [I] defining the alkyl chain composition indicates a value calculated by dividing a sum of the numbers of alkyl chains having $C_{16}$, $C_{18}$, $C_{20}$ and more carbon atoms with or without a certain coefficient by the number of alkyl chains having $C_{14}$ and less carbon atoms (this divided value is identified by "A value", hereinbelow) is not less than 1. In the equation [I], it is noted that the coefficient increases with increase of the number of carbon atoms contained in the alkyl chain. This suggests that the sizing effect against a developing solution is highly influenced by the length of alkyl chains. The present tendency given by the alkyl chain length is very characteristic in the sizing effect only against a developing solution, while variation of the alkyl chain length influences other general sizing effects at an extremely low level.

The alkylketene dimer of the invention is preferably included in the paper sheet in an amount of 0.2–2.0% by weight of the absolutely dried pulp constituting the paper sheet.

The alkylketene dimer of the invention can be employed alone or in combination with other reactive and/or unreactive sizing agents. Moreover, other additives employable in the paper preparation, such as a paper strength increasing agent, a fixing agent, a preserving agent, a filler, a dye and an antistatic agent, can be employed in conjunction with the alkylketene dimer of the invention.

The alkylketene dimer can be incorporated into a paper sheet, generally, by an internal sizing method. In carrying out the internal sizing method, the alkylketene dimer is dispersed in water, generally, in the presence of a dispersing agent, such as cationic, anionic or nonionic agent. If desired, the alkylketene dimer can be applied onto the surface of paper sheet by a surface sizing method.

The preparation of a paper sheet to be included in a photographic support can be carried out in a conventional way from an aqueous slurry containing pulp material, a sizing agent, and, optionally, other additives.

There is no limitation on nature of the pulp constituting the paper sheet, as far as it belongs to those employable in the manufacture of paper sheets for photographic supports. Examples of the pulp materials include cellulose-type pulps such as wood pulps, esparto pulps, and straw pulps. A part of the cellulose-type pulp material can be replaced with a synthetic pulp material.

The paper sheet containing the alkylketene dimer is then coated on both surfaces with a polyolefin in a conventional way to prepare a photographic support. A polyolefin generally is polyethylene which is an ethylene homopolymer, or a copolymer of ethylene and one or more of copolymerizable monomers. In the polyethylene copolymer, the copolymerizable monomer preferably amounts to not more than 10% by weight of the ethylene content. Examples of the copolymerizable monomers include alfaolefins such as propylene and butene-1; vinyl compounds such as styrene, vinyl stearate, vinyl acetate, acrylic acid, methyl acrylate, ethyl acrylate, acrylamide, methacrylic acid, methyl methacrylate, ethyl methacrylate, methacrylamide; and diene compounds such as butadiene and isoprene.

The photographic support of the invention contains, as described hereinabove, the alkylketene dimer having specifically defined alkyl chain composition in the paper sheet layer provided between the polyolefin coating layers. This paper sheet layer is prominently resistant to permeation of a developing solution comprising an alkaline solution and an alcohol. It is very advantageous that the alkylketene dimer of the invention is effective against the permeation of a developing agent with no auxiliary sizing agent. Also advantageous is that the process for the preparation of the paper sheet is simplified because only a relatively small number of agents or additives are required in the process.

The present invention is further illustrated by the following examples, which are by no way intended to restrict the invention.

EXAMPLES

(1) Preparation of Test Samples

To an aqueous slurry containing wood pulp fibers (LBKP/NBKP=2/1) beaten to the Canadian freeness level 240 cc. was added polyamide-polyamine-epichlorohydrin (Kymene 557, trade mark of DIC-HERCULES Co., Ltd., Japan) in the amount of 0.7% by weight (based on the absolutely dried pulp content, the same hereinbelow) as a preserving agent. Further added was the alkylketene dimer set forth in Table 1 in the amount of 0.7% by weight. The pulp slurry was then processed in a conventional way to prepare a paper sheet weighing 170 g/m$^2$.

One surface (back surface) of the paper sheet was coated with polyethylene of the density of approximately 0.980 g./cm$^3$ to form a coating layer of approximately 0.033 mm thick. Another surface (front surface) of the paper sheet was then coated with polyethylene of the density of approximately 0.960 g./cm$^3$ containing titanium dioxide (10 % by weight) to form a coating layer of approximately 0.030 mm thick. Thus, photographic supports were prepared.

TABLE 1

| Test Sample No. | Alkyl chain composition | | | | A value according to Equation [I] |
|---|---|---|---|---|---|
| | $C_{14}$ and less | $C_{16}$ | $C_{18}$ | $C_{20}$ and more | |
| 1 | 55% | 45% | — | — | 0.27 |
| 2 | 38 | 62 | — | — | 0.54 |
| 3 | 30 | 68 | 2% | — | 0.82 |
| 4 | 24 | 76 | — | — | 1.06 |
| 5 | 11 | 89 | — | — | 2.69 |
| 6 | 82 | 7 | 1 | 10% | 1.26 |
| 7 | 55 | 20 | 2 | 23 | 4.34 |
| 8 | 36 | 10 | 3 | 51 | 14.3 |

(2) Evaluation on Prevention of Edge soiling

The eight test samples were subjected to evaluation on the edge soiling liability. The evaluation was carried out by the procedures set forth below.

The photographic support sample was cut to produce a test strip of 8.25 cm wide. The test strip was then developed in Color Paper Automatic Development Apparatus RPV-409 Type (available from Noritu Koki Co., Ltd., Japan), and subjected to eye measurement through a loupe of the depth of developing solution permeation from the edge section face.

The results of the evaluation are set forth in Table 2.

TABLE 2

| Test Sample No. | Depth of Developing Solution permeation (mm) |
|---|---|
| 1* | 0.70 |
| 2* | 0.61 |
| 3* | 0.56 |

TABLE 2-continued

| Test Sample No. | Depth of Developing Solution permeation (mm) |
|---|---|
| 4 | 0.33 |
| 5 | 0.28 |
| 6 | 0.32 |
| 7 | 0.25 |
| 8 | 0.20 |

Note:
Test Samples No. 1 through No. 3 given the asterisk all represent test samples for comparison purpose.

The results set forth in Table 2 clearly indicate that the photographic support of the invention is remarkably improved in the edge soiling liability as compared with the photographic supports represented by the Comparison Test Samples No. 1 through No. 3.

We claim:

1. A photographic support comprising a photographic layer sensitive to light and a polyolefin-coated paper layer comprising a paper sheet which contains an alkylketene dimer mixture in an amount of 0.2–2.0% by weight of the absolutely dried pulp constituting the paper sheet and is coated with a polyolefin on both surfaces; wherein said alkylketene dimer mixture consists essentially alkyl chains having 14 carbon atoms or less than 14 carbon atoms in the chain, an alkyl chain having 16 carbon atoms in the chain, and at least one alkyl chain having 18 carbon atoms in the chain and alkyl chains of 20 carbon atoms or more than 20 carbon atoms in the chain under the condition satisfying the following equation $$\frac{\frac{1}{3} \times [C_{16}] + [C_{18}] + 10 \times [C_{20} \text{ and more}]}{[C_{14} \text{ and less}]} \geqq 1$$

in which

[$C_{14}$ and less] means the amount of alkyl chains having carbon atoms of 14 and less;

[$C_{16}$] means the amount of an alkyl chain having 16 carbon atoms;

[$C_{18}$] means the amount of an alkyl chain having 18 carbon atoms; and

[$C_{20}$ and more] means the amount of alkyl chains having carbon atoms of 20 and more, the alkyl chain amounts being represented by percent in number of the total alkyl chain amount of the alkylketene dimer composition mixture wherein [$C_{18}$] and [$C_{20}$ and more] are each 0.

* * * * *